US006085823A

United States Patent [19]

Oskam

[11] Patent Number: 6,085,823

[45] Date of Patent: Jul. 11, 2000

[54] COVERING ASSEMBLY FOR AN ARCHITECTURAL OPENING

[75] Inventor: Herman Oskam, Vlist, Netherlands

[73] Assignee: Hunter Douglas International N.V., Netherlands Antilles

[21] Appl. No.: 09/024,260

[22] Filed: Feb. 17, 1998

[30] Foreign Application Priority Data

Feb. 19, 1997 [EP] European Pat. Off. ..... 97200475

[51] Int. Cl.[7] ..... E06B 9/30

[52] U.S. Cl. ..... 160/172 R; 160/84.06

[58] Field of Search ..... 160/172 R, 172 V, 160/84.03, 84.06, 84.01, 173 R, 168.1 R

[56] References Cited

U.S. PATENT DOCUMENTS 4,433,713 2/1984 Kelly .
4,557,309 12/1985 Judkins .
4,673,018 6/1987 Judkins .
4,733,711 3/1988 Schon .
4,753,281 6/1988 Wagner .
5,460,215 10/1995 Schon .

FOREIGN PATENT DOCUMENTS 388788 9/1990 European Pat. Off. .

*Primary Examiner*—David M. Purol
*Attorney, Agent, or Firm*—Dorsey & Whitney LLP

[57] ABSTRACT

A window covering assembly has first and second rails adapted to be secured to first and second sides of a window frame, at least one resiliently tensionable cable member (16) extending between the first and second rails, and a flexible covering material (14) being supported and guided by the tensionable cable members between extended and contracted conditions of the material. Sliders (18) and locking mechanisms or clamps (44) are provided to tension the cable members (16). Each slider (18), to which at least one cable member (16) is attached, is manually longitudinally slidable along one of the rails and has a clamp associated with it, preferably a self-locking clamp formed on the slider, to clamp the slider at a desired location on the second rail (12).

7 Claims, 4 Drawing Sheets

COVERING ASSEMBLY FOR AN ARCHITECTURAL OPENING

BACKGROUND OF THE INVENTION a. Field of the Invention

This invention relates to an architectural opening covering assembly, particularly a covering assembly which can be mounted on a door or window frame. This invention particularly relates to a covering assembly, such as a Venetian blind or a pleated shade, which includes a tensioned guide wire, cord or cable.

b. Background Art.

Such assemblies are used on inclined surfaces or on moving objects such as doors or vehicle windows. Examples of such assemblies are the shades and blinds shown in U.S. Pat. Nos. 4,433,713, 4,733,711, 4,753,281, 4,433,713, and 4,673,018 and EP-B-0 388 788. However, it has been found difficult to remove such assemblies for cleaning.

In order to overcome this problem, U.S. Pat. No. 5,460,215 has described the use of over-center latch levers on the front of a window covering assembly for releasably holding the assembly in engagement with mounting brackets on a door or window frame. This removable assembly has included: a longitudinally-elongate first or upper rail, the ends of which are releasably held in engagement with the mounting brackets on the top of the frame; a longitudinally-elongate second or lower rail, the ends of which are releasably held in engagement with the mounting brackets on the bottom of the frame; a pair of resiliently tensionable cables extending between the two rails; and a flexible covering supported and guided by the cables between extended and retracted conditions relative to the window opening. The over-center latch levers have been adapted for tensioning the cables to hold the upper and lower rails in engagement with the mounting brackets on the frame and for releasing tension in the cables so as to allow the lower rail to be initially disengaged from the mounting brackets on the bottom of the frame and allow the upper rail to be thereafter disengaged from the mounting brackets on the top of the frame. While this assembly has been reasonably satisfactory, its over-centre latch levers have been considered to be relatively large and unsightly, particularly when used with assemblies of smaller blinds or shades.

SUMMARY OF THE INVENTION

In order to overcome the problems with the removable window covering assembly of U.S. Pat. No. 5,460,215, this invention provides means for tensioning each cable of the assembly characterized by: a slider which is manually movable along the first or second rail and which is attached to the cable; and a clamp on the slider to hold the slider at a desired location on the rail, to provide a desired tension in the cable so that the rail is either held in engagement with mounting brackets on the frame or free to be released from its engagement with the mounting brackets on the frame. The slider of this invention can be manually operated exteriorly of the rail, on which it slides, and such rail can be attached to a window or door frame. Removal of the assembly for cleaning either the window itself or the assembly is in the reverse order of the steps for mounting the assembly on a window frame. After release of the tension in the cable, it is possible to disengage the rail from the mounting brackets holding it to the frame.

In accordance with another aspect of this invention, the clamp on the slider is a self-locking clamp, and the cable is attached to the clamp.

In accordance with still another aspect of this invention, the rail associated with each slider advantageously has a continuous longitudinally-extending lateral surface and a constant transverse cross-section, and the clamp includes releasable means for lockingly engaging the lateral surface of the rail.

In accordance with yet another aspect of this invention, such releasable means advantageously comprises a bent wire spring having a free end urged against the lateral surface of the rail and one end of the cable is attached to the bent wire spring. The spring is preferably a symmetrical spring, having two free ends urged against the lateral surface of the rail. In a particularly advantageous construction, the slider includes one or more ramp surfaces engageable with the wire spring adjacent its free end(s) to deflect the free end(s) from the lateral surface of the rail, thereby allowing movement of the slider along the rail.

While the slider of this invention can be mounted on either the upper or lower rail of a window covering assembly, in accordance with another aspect of this invention, it is mounted on the rail which is initially disengaged from the mounting brackets on the frame of the window or door.

Further aspects of the invention will be apparent from the detailed description below of particular embodiments and the drawings thereof.

DESCRIPTION OF THE PREFERRED EMBODIMENTS

Figure 1:
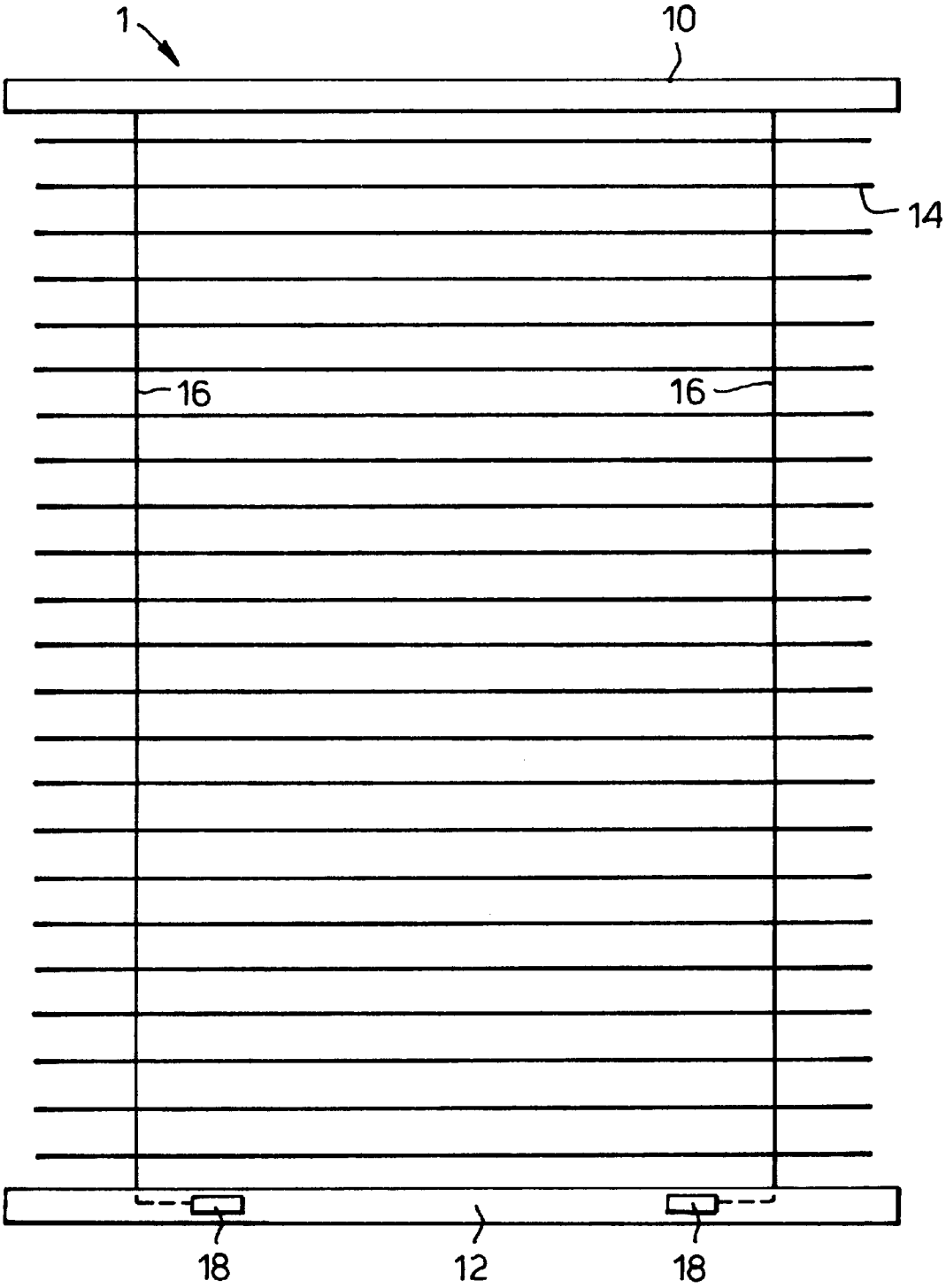
FIG. 1 is a schematic view of one embodiment of a window covering assembly according to the invention.

Referring first to FIG. 1, there is illustrated schematically a covering assembly, generally 1, preferably a shade or blind, for an architectural opening, such as a window or door. The covering assembly 1 has a first or upper rail 10 which is releasably secured to the frame of a window (not shown) by conventional means such as mounting brackets (not shown). The covering assembly 1 also has a second or lower rail 12 releasably secured again by conventional means such as brackets (not shown) to the window frame. As is conventional with this type of assembly, one or more, in this instance two, tensioned cables 16 are also provided. These cables 16 are secured to the upper rail 10 and to the lower rail 12 in a tensionable manner which will be described below in relation to the sliders 18. A flexible covering 14 is supported and guided by the cables 16 and can be extended and retracted vertically between the rails 10, 12 by conventional means. In this regard, the rails 10 and 12, the covering 14 and the cables 16 of the covering assembly 1 are very similar to those shown and described in U.S. Pat. No. 5,460,215.

In accordance with this invention, the covering assembly 1 also includes means for tensioning each cable 16 of the assembly. Such means are in the form of: two sliders 18, each of which is manually movable longitudinally along the lower rail 12 and each of which is attached to one of the cables 16; and a locking mechanism or clamp 44 on the slider 18 to hold the slider at a desired longitudinal location on the rail and at a desired tension of the cable for either securing the lower rail 12 to mounting brackets holding it to the frame or releasing it from the mounting brackets holding it to the frame.

Figure 2:
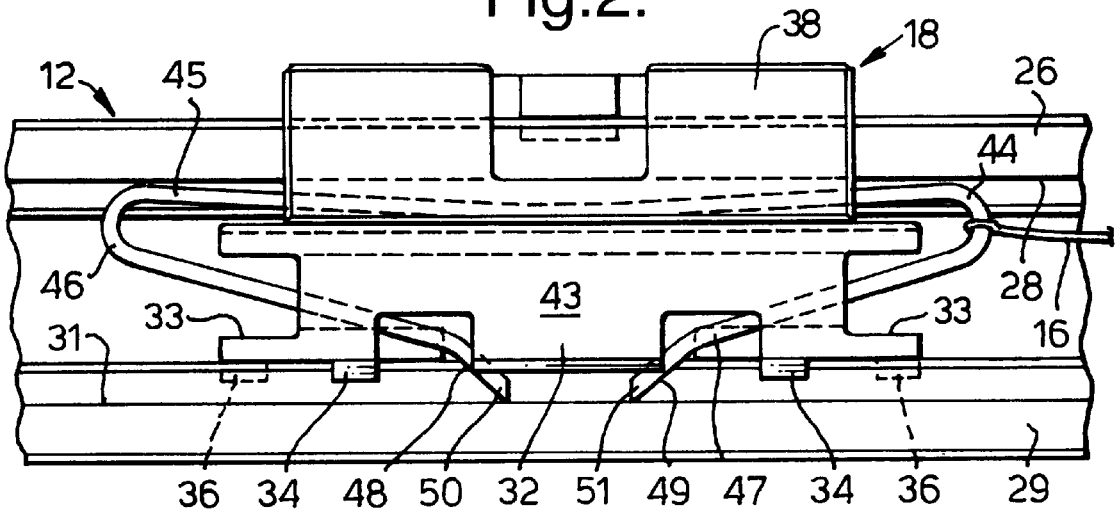
FIG. 2 is a plan view from beneath the lower rail of the assembly of FIG. 1, which view is normally hidden against the lower window frame and which shows the slider and its locking clamp on the lower rail.
Figure 4:
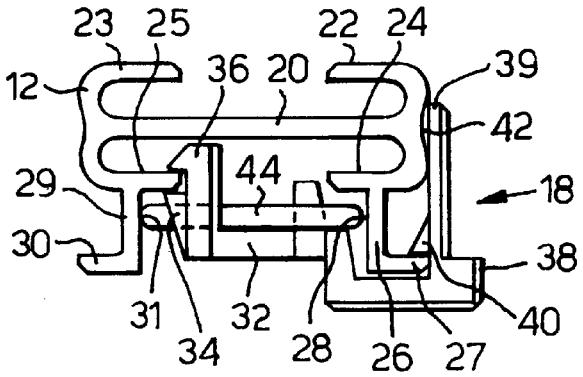
FIG. 4 is an enlarged side elevation view of the lower rail of FIG. 2 with the slider shown in position on the lower rail.

FIGS. 2 and 4 show details of one of the sliders 18 and its clamp 44 on the lower rail 12.

As best seen in FIG. 4, the lower rail 12 includes, along its entire length, a main horizontal web or beam 20, and on either side of the main beam 20 and substantially parallel to it are two horizontal upper flanges 22, 23, connected to the front and rear of the main web, and two horizontal lower flanges 24, 25, also connected to the front and rear of the main web 20. The upper and lower flanges 22–25 have horizontal gaps between them on the upper and lower sides of the main web 20. The lower front flange 24 has a downwardly-extending member 26 with a frontally-extending flange 27 at its lower end and with a rearwardly-facing surface 28. The lower rear flange 25 also has a downwardly-extending member 29 with a rearwardly-extending flange 30 at its lower end and with a frontally-facing surface 31. The free longitudinal ends (not shown) of the laterally-extending flanges 27, 30 are adapted to engage brackets (not shown) for mounting the lower rail 12 to a window frame (also not shown) in a conventional manner.

The slider 18 is preferably formed as a moulding of a plastic material adapted to slide along the constant cross-section of the lower rail 12 . In this regard, the lower rail is preferably extruded to have the constant shape shown in cross-section in FIG. 4, including its continuous, longitudinally-extending, frontal lateral surface 31.

Figure 3:
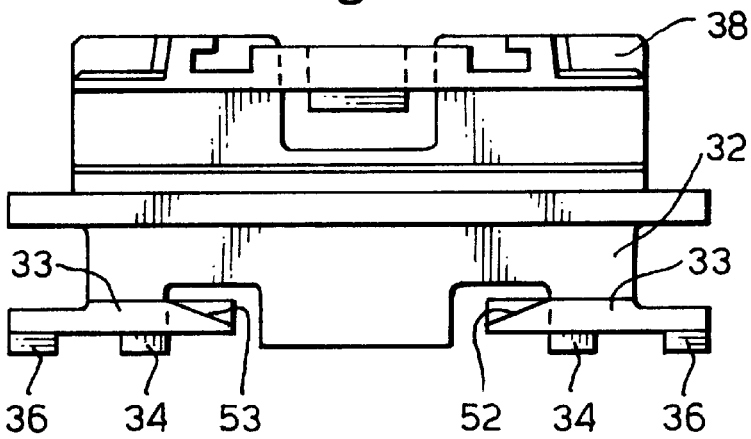
FIG. 3 is an enlarged elevation view of the slider of FIG. 2 from above the slider.

FIGS. 2–4 show the slider 18 with its horizontally-extending bottom portion 32, at the rear of which are a pair of parallel, longitudinally-spaced, upwardly-extending flanges 33. At the rear of each flange 33 are lower and upper, rearwardly-extending retaining dogs 34 and 36 engaging, and preferably slidingly abutting, the lower and upper surfaces respectively of the lower rear flange 25 of the lower rail 12. Connected to the front of the bottom portion 32 is a front or exterior portion 38 which includes an upwardly-extending flange 39 on the front thereof. The flange 39 has, at the rear thereof, another rearwardly-extending retaining dog 40. The retaining dog 40 and the upper surface of the front portion 38 engage, and preferably slidingly abut, the upper and lower surfaces respectively of the frontally-extending flange 27 of the downwardly-extending member 26 on the lower front flange 24 of the lower rail 12. The rear surface 42 of the upwardly-extending flange 39 of the front portion 38 of the slider 18 also is adapted to slide along the front of the rail 12. With this arrangement, the slider 18, by itself, is freely movable longitudinally along the rail 12.

Figure 5:
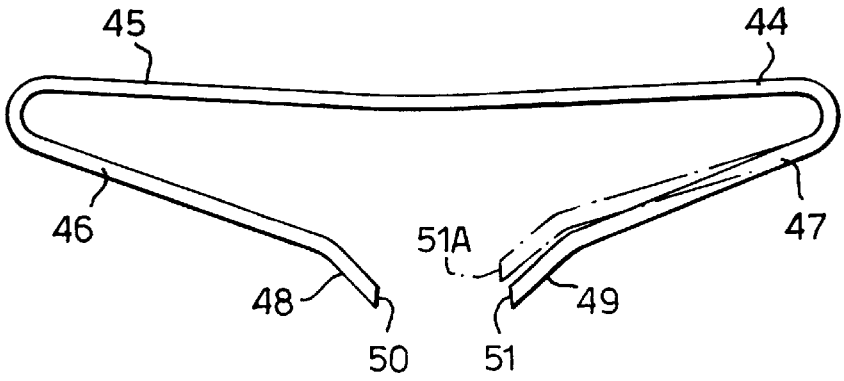
FIG. 5 is a plan view of the bent wire locking clamp associated with the slider of FIG. 2.
Figure 6:
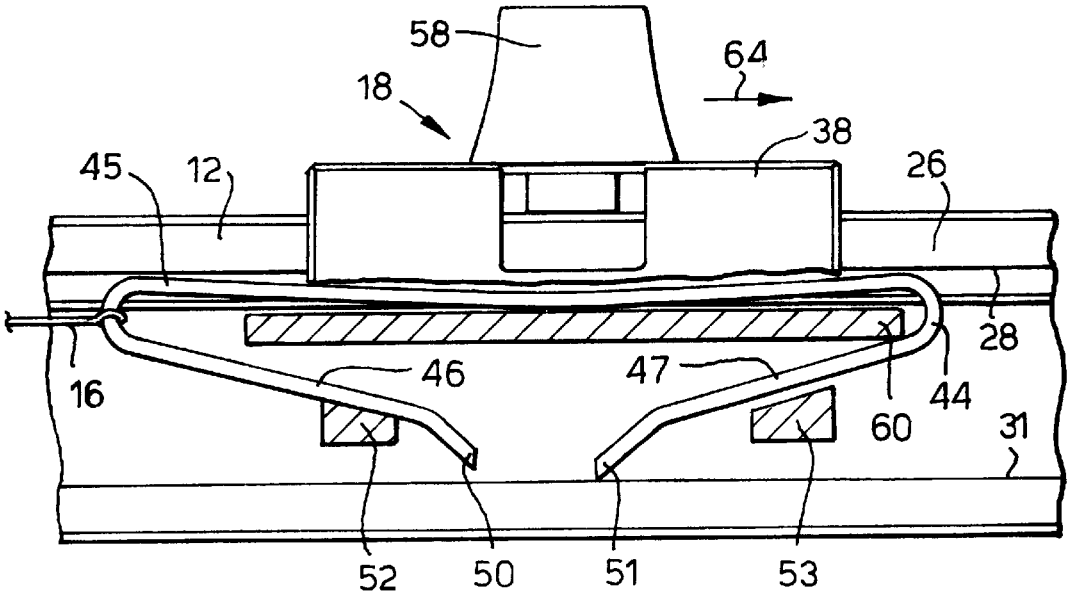
FIG. 6 is a plan view, partly in section but similar to FIG. 2, of a bottom rail of a window covering assembly with an alternative embodiment of a slider.

As shown in FIGS. 2, 5 and 6, a bent spring wire clamp 44 is mounted horizontally within the slider 18, above its horizontally-extending bottom portion 32. The clamp 44 is symmetrical and includes a longitudinally-extending base portion 45, parallel to the front of the slider 18, and inwardly bent, converging legs 46, 47 extending rearwardly from the longitudinal ends of the base portion 45. The free rear ends 48, 49 of the legs 46, 47 are chamfered to form sharp edges 50, 51 which are in sliding abutting relationship to the confronting frontal lateral surface 31 of the downwardly-extending member 29 of the lower rear flange 25 of the lower rail 12.

Shown in FIGS. 2 (in chain-dotted lines), 3 and 6 are rearwardly converging ramp surfaces 52,53 on the facing longitudinal edges of the pair of longitudinally-spaced, upwardly-extending flanges 33 on the horizontally-extending bottom portion 32 of the slider 18. Each ramp surface 52, 53 abuts, and can engage, the rear of one of the legs 46, 47 of the spring 44.

As shown in FIG. 2, a right-hand portion of the spring wire clamp 44 on the slider 18 is attached to one of the cables 16. In use, in order to tension the cable 16, the slider 18 is moved manually to the left by simply pushing the right side of its front portion 38 to the left. Doing this causes the slider 18 and its ramp surface 53, abutting the right-hand leg 47 of the clamp 44, to move initially relative to the clamp 44 whereby ramp surface 53 urges the right-hand leg 47 frontally so that the sharp edge 51 on its free end 49 is pushed to a location 51A shown (in chain-dotted lines) in FIG. 5, spaced frontally away from the frontally-facing surface 31 of the downwardly-extending member 29 of the lower rear flange 25 of the lower rail 12. Continued movement to the left of the slider 18 will allow the whole slider and clamp assembly to move to the left, the other sharp edge 50 on the free end 48 of the left-hand leg 46 being moved in a direction away from its gripping action along the frontally-facing surface 31 of the downwardly-extending member 29 of the lower rear flange 25 of the lower rail 12. When the cable 16 is adequately tensioned to hold the lower rail 12 in engagement with mounting brackets on the frame, the pushing force is removed from the right side of the slider 18 which then will move back slightly to the right due to the action of the relaxing spring wire clamp 44. In this regard, tension in the cable 16 will tend to pull the clamp 44 back to the right, but the sharp edge 50 of the left-hand leg 46 of the clamp 44 and to a lesser extent its other sharp edge 51 of the right-hand leg 47, which edges are now both in contact with the frontally facing surface 31 of the downwardly-extending member 29 of the lower rail 12, will prevent any further movement of the clamp 44 and slider 18 to the right.

Thus, the spring wire clamp 44 provides a self-locking feature for the slider 18, locking the slider and the cable 16, attached to it, at the desired location on the lower rail 12, thereby maintaining the tension in the cable.

Figure 7:
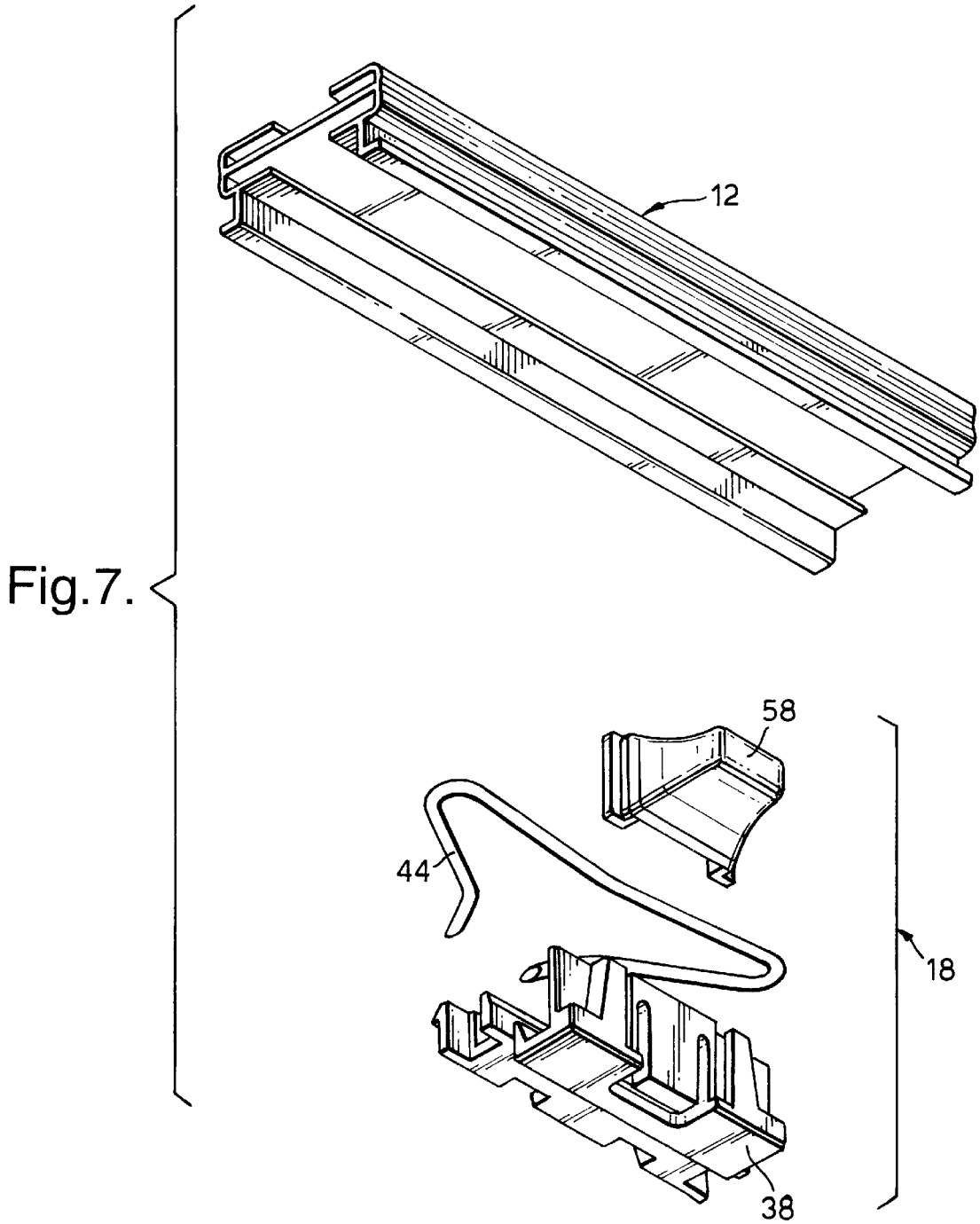
FIG. 7 is an exploded view from beneath the lower rail of the assembly of FIG. 6.

A slightly modified structure for the slider 18 is illustrated in FIGS. 6 and 7, and like parts have been indicated by like reference numerals. In this embodiment, the front portion 38 of the slider 18 is formed as a hand grip with an opening 58, and an inner portion 60 of the slider has a slightly modified shape to more easily receive the spring wire clamp 44. The cable 16 has been attached to the left-hand leg 46 of the clamp 44, so that movement of the slider 18 to the right, as indicated by arrow 64, will cause the ramp surface 52 to engage the left-hand leg 46 of the clamp, thereby lifting the left-hand sharp edge 50 of the clamp away from the frontally-facing surface 31 of the downwardly-extending member 29 of the lower rear flange 25 of the lower rail 12, allowing the slider 18, and thus the cable 16, to move to the right to tension the cable.

In the above description of the covering assembly 1 of this invention, the assembly has been described as having conventional upper and lower rails 10, 12 attached to opposite window frame members. However, it should be understood that the upper rail 10 could further include a conventional retractor mechanism for the flexible covering material 14, and the lower end of the flexible covering material could be provided with an additional conventional, movable weight bar or stiffening member. In this regard, the retractor mechanism for the flexible covering material could be in the form of conventional lift cords having their ends attached to such a weight bar or stiffening member and cooperating with a cord lock for contracting the flexible covering material. Alternatively, the flexible covering material could itself be attached to a conventional spring or cord- operated roller for storing the flexible covering material.

Further, it is not unusual for such a covering assembly to have a number of individual sections, each including movable bars or beams so as to provide a plurality of the same or different covering materials in between them.

Finally, the flexible covering material 14 can be pleated or unpleated shade cloth or be formed by an array of blinds slats interwoven with ladder cords.

The invention is, of course, also not limited to the above-described embodiments which may be modified without departing from the scope of the invention or sacrificing all of its advantages. In this regard, the terms in the foregoing description, such as "upper", "lower", "front", "rear", "upwardly", "downwardly", "right" and "left", have been used only as relative terms to describe the relationships of the various elements of the covering assembly of the invention.

What is claimed is:

1. A covering assembly, which is mountable on a door or window frame having a first side and a second opposite side, said assembly comprising a first rail adapted to be secured to said first side of said window or door frame, a second rail adapted to be releasably secured to said second, opposite side of said frame, a resiliently tensionable cable extending between said first and second rails, a flexible covering material supported and guided by said cable, between extended and retracted positions of said flexible covering material with respect to said door or window, and tensioning means to tension said cable, wherein said tensioning means comprises: a slider having an exterior portion and being freely movable longitudinally along one of said first and second rails by pushing on said exterior portion, and a self-locking clamp on said slider, said self-locking clamp being attached to said cable, wherein said clamp comprises manually releasable means for lockingly engaging said one of said first and second rails to hold said slider at a desired location along said one of said first and second rails to provide a desired tension in said cable, so that said one of said first and second rails is either held in engagement with said frame or is free to be released from its engagement with said frame.

2. The assembly of claim 1, wherein said one of said first and second rails has a continuous, longitudinally-extending, lateral surface and a constant transverse cross-section, and said releasable means comprises at least one leg having a free end that selectively binds against said lateral surface of said one of said first and second rails.

3. The assembly according to claim 1, wherein said one of said first and second rails along which said slider is moveable longitudinally is a lower rail of said covering assembly.

4. A covering assembly, which is mountable on a door or window frame having a first side and a second opposite side, said assembly comprising a first rail adapted to be secured to said first side of said window or door frame;

a second rail adapted to be releasably secured to said second, opposite side of said frame;

a resiliently tensionable cable extending between said first and second rails;

a flexible covering material supported and guided by said cable between extended and retracted positions of said flexible covering material with respect to said door or window; and tensioning means to tension said cable, wherein said tensioning means comprises a slider manually movable along one of said first and second rails, wherein said one of said first and second rails has a continuous, longitudinally-extending, lateral surface and a constant transverse cross-section; and a clamp on said slider, said clamp comprising releasable means for lockingly engaging said lateral surface of said one of said first and second rails to hold said slider at a desired location along said one of said first and second rails, to provide a desired tension in said cable, so that said one of said first and second rails is either held in engagement with said frame or is free to be released from its engagement with said frame, wherein said releasable means comprises a bent wire spring having a free end urged against said lateral surface, and further wherein said cable is attached to said spring.

5. The assembly of claim 4, wherein said spring is symmetrical and further comprises two free ends and two sharpened edges on said free ends urged against said lateral surface of said one of said first and second rails.

6. The assembly of claim 4, wherein said slider further comprises a ramp surface engageable with said spring adjacent a free end of said spring effective to remove its sharpened edge from said lateral surface and thereby allow movement of said slider along said one of said first and second rails.

7. The assembly of claim 6, wherein said slider comprises a pair of ramp surface engageable with said spring adjacent said two free ends of said spring to remove said sharpened edges from said lateral surface and thereby allow movement of said slider along said one of said first and second rails.

* * * * *